US007661431B1

(12) United States Patent
Barrios

(10) Patent No.: US 7,661,431 B1
(45) Date of Patent: Feb. 16, 2010

(54) CIGAR HOLDER AND ASHTRAY

(76) Inventor: Danny W. Barrios, 77110 Golf Club Dr., Diamondhead, MS (US) 39525

( * ) Notice: Subject to any disclaimer, the term of this patent is extended or adjusted under 35 U.S.C. 154(b) by 529 days.

(21) Appl. No.: 11/648,327

(22) Filed: Dec. 29, 2006

Related U.S. Application Data

(63) Continuation-in-part of application No. 10/741,317, filed on Dec. 22, 2003, now abandoned.

(51) Int. Cl.
*A24F 19/02* (2006.01)

(52) U.S. Cl. ..... 131/241; 206/246

(58) Field of Classification Search ..... 131/241; 206/246
See application file for complete search history.

(56) References Cited

U.S. PATENT DOCUMENTS

| | | | | | |
|---|---|---|---|---|---|
| 1,840,210 | A | * | 1/1932 | Reekers | 131/257 |
| 2,047,786 | A | | 7/1936 | Kuntz | |
| 2,588,208 | A | * | 3/1952 | Connellan | 131/240.1 |
| 2,647,523 | A | * | 8/1953 | Vollender, Jr. | 131/257 |
| 2,786,476 | A | * | 3/1957 | Garson | 131/242.6 |
| 2,880,736 | A | * | 4/1959 | Lookholder | 131/242 |
| 3,364,937 | A | | 1/1968 | D'Amaro | |
| 3,796,224 | A | * | 3/1974 | Feinstat | 131/242.5 |
| 3,978,981 | A | * | 9/1976 | Musick | 206/276 |
| 4,187,864 | A | * | 2/1980 | Taddeo | 131/242 |
| 5,829,450 | A | * | 11/1998 | Hicaro et al. | 131/235.1 |
| 5,842,481 | A | | 12/1998 | King | |
| D403,804 | S | | 1/1999 | Silkaitis | |
| 5,915,388 | A | | 6/1999 | Bowen et al. | |
| 6,109,271 | A | | 8/2000 | Webber et al. | |
| D493,011 | S | * | 7/2004 | Foote | D27/104 |
| 2003/0024540 | A1 | | 2/2003 | Gibertini | |

* cited by examiner

*Primary Examiner*—Khanh Nguyen
*Assistant Examiner*—John Blades
(74) *Attorney, Agent, or Firm*—George L. Williamson

(57) ABSTRACT

An apparatus for a combination cigar holder and ash tray. The ash tray is formed as a base having a bottom and cylindrical walls surrounding it. The base is the container wherein the ashes from the cigar holder will fall therein or be otherwise placed. The cigar holder portion of the present invention is designed to receive a lit cigar therein. The cigar holder has means for connection to the base along with a screen for receiving the lit end of the cigar so that the ashes will fall through the screen into the ash tray. The cigar holder also has slotted recesses designed so that a user can grasp the cigar in multiple places by placing the fingers of the user within the recesses and may have a circumferential collar on one end of the holder and a rotatable partial collar on the other end of the holder to secure a cigar in the cigar holder.

8 Claims, 6 Drawing Sheets

Figure 1
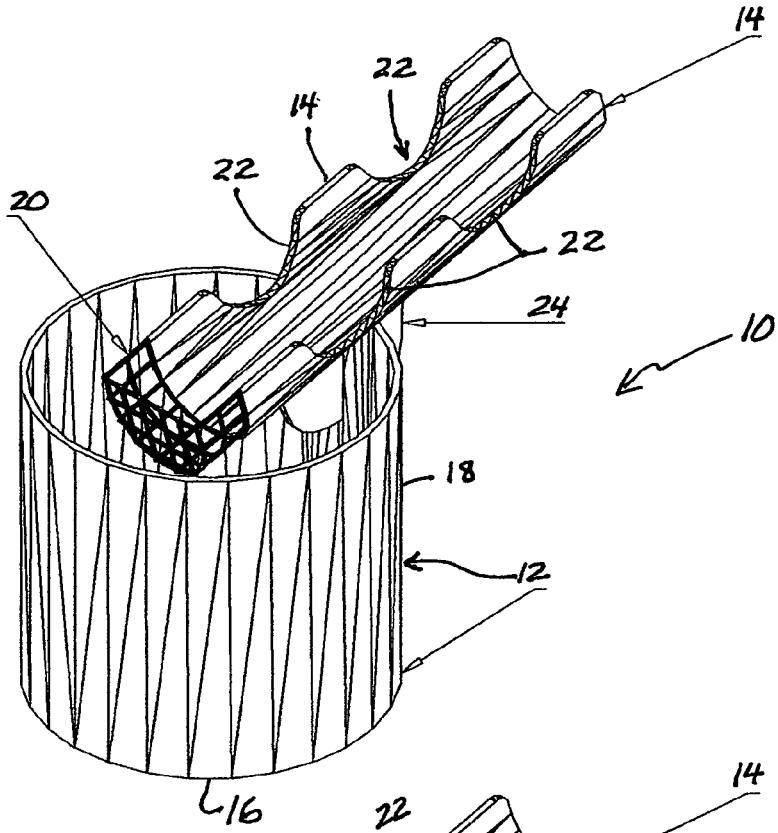
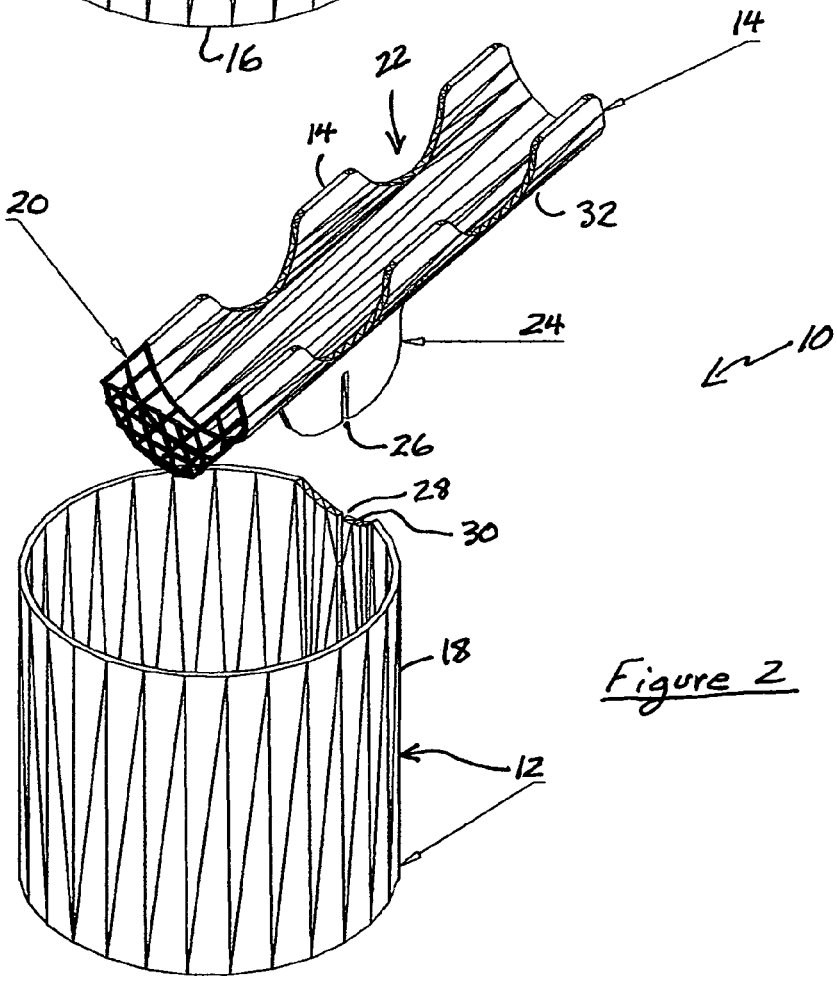
Figure 2

CIGAR HOLDER AND ASHTRAY

RELATED APPLICATIONS

This application is a Continuation-in-Part of U.S. patent application Ser. No. 10/741,317 filed on Dec. 22, 2003 now abandoned.

BACKGROUND OF THE INVENTION

1. Field of the Invention

The present invention relates generally to cigars and, more specifically, is concerned with a holder and ash tray for a cigar.

2. Description of the Prior Art

Cigar holders have been described in the prior art; however, none of the prior art devices disclose the unique features of the present invention.

In U.S. Pat. No. Des. 403,804, dated Jan. 5, 1999, Silkaitis disclosed the ornamental design for a cigarette and cigar ashtray for any cup holder, as shown and described.

In U.S. Pat. No. 2,047,786, dated Jul. 14, 1936, Kuntz disclosed an invention which relates to improvements in cigarette and cigar holders, and has for an object among others the provision of means for holding a cigarette over an ashtray in such a manner as to insure the cigarette or any part of it or the ashes thereof from falling on the table, which means may be made in one or more pieces. It also has for an object the provision of such a holder wherein the cigarette held will deposit its ashes in the ashtray and to which the cigarette will not stick.

In U.S. Pat. No. 5,842,481, dated Dec. 1, 1998, King disclosed a cradle or tray for holding a lit tobacco product having a V-shaped tray made of aluminum using 90 degree angle stock approximately 1/10 inch thick. A support arm made of a series of plastic link connected at one end to the tray and at its opposite end to a releasable clamp. The tray is fastened to the first link of element of the support arm with a flat heat machine screw. The last link or element is fastened to the clamp by a similar screw and nut so that the user can grasp the operating levers of the clamp. The clamp grip is large enough to grasp various support structures such as parts of a golf bag or in an appropriate location on a drivable golf cart.

In U.S. Pat. No. 6,109,271, dated Aug. 29, 2000, Webber, et al., disclosed a cigar holder for a vehicle which is formed with one portion to support a cigar and another portion of non-heat conducting and weather resistant material to protect the vehicle from the heat of the cigar and the cigar holder from the deleterious effects of the weather. The cigar holder is attached to the vehicle by a suction cup which is concealed by an insert which is selectable to give the cigar holder different appearances.

In U.S. Pat. No. US 2003.0024549 A 1, dated Feb. 6, 2003, Gibertini disclosed a cigar caddie that has an elongated part tubular and part semi-tubular member for holding a cigar in the semi-tubular portion, and a hook or other securing member to secure the cigar caddie to a golf bag or golf cart. When the golfer is ready to make his next shot, he can put his lit cigar in the semi-cylindrical receiving cavity of the cigar caddie which has been secured to the golf bag or cart by placing the hook over the upper edge of the golf bag or over an available portion of the frame of the golf cart. The cigar caddie can be easily and quickly hooked onto the golf bag or cart and just as easily and quickly removed therefrom. It is a small, compact item that can be readily stored in the golf bag and carried along from hole to hole.

While these cigar holders may be suitable for the purposes for which they were designed, they would not be as suitable for the purposes of the present invention, as hereinafter described.

SUMMARY OF THE PRESENT INVENTION

The present invention discloses a combination cigar holder and ash tray. The ash tray is formed as a base having a bottom and cylindrical walls surrounding it. The base is the container wherein the ashes from the cigar holder will fall therein or be otherwise placed. The cigar holder portion of the present invention is designed to receive a lit cigar therein. The cigar holder has means for connection to the base along with a screen for receiving the lit end of the cigar so that the ashes will fall through the screen into the ash tray. The cigar holder also has slotted recesses designed so that a user can grasp the cigar in multiple places by placing the fingers of the user within the recesses and may have a circumferential collar on one end of the holder and a rotatable partial collar on the other end of the holder to secure a cigar in the cigar holder.

An object of the present invention is to provide a cigar holder for placement in a standard size, drink holding cup which might be found in an automobile, a boat, a golf cart or on a golf bag. A further object of the present invention is to provide the holder for a cigar to be a removable attachment to the base. A further object of the present invention is to provide means for cleaning the ashes from the end of a lit cigar. A further object of the present invention is to provide finger slots wherein the user can grasp a cigar in multiple places.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. Therefore, the scope of the present invention is best defined by the appended claims. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which:

FIG. 1 is a perspective view of one embodiment the present invention.

FIG. 2 is an exploded perspective view of one embodiment of the present invention.

LIST OF REFERENCE NUMERALS

Figure 3:
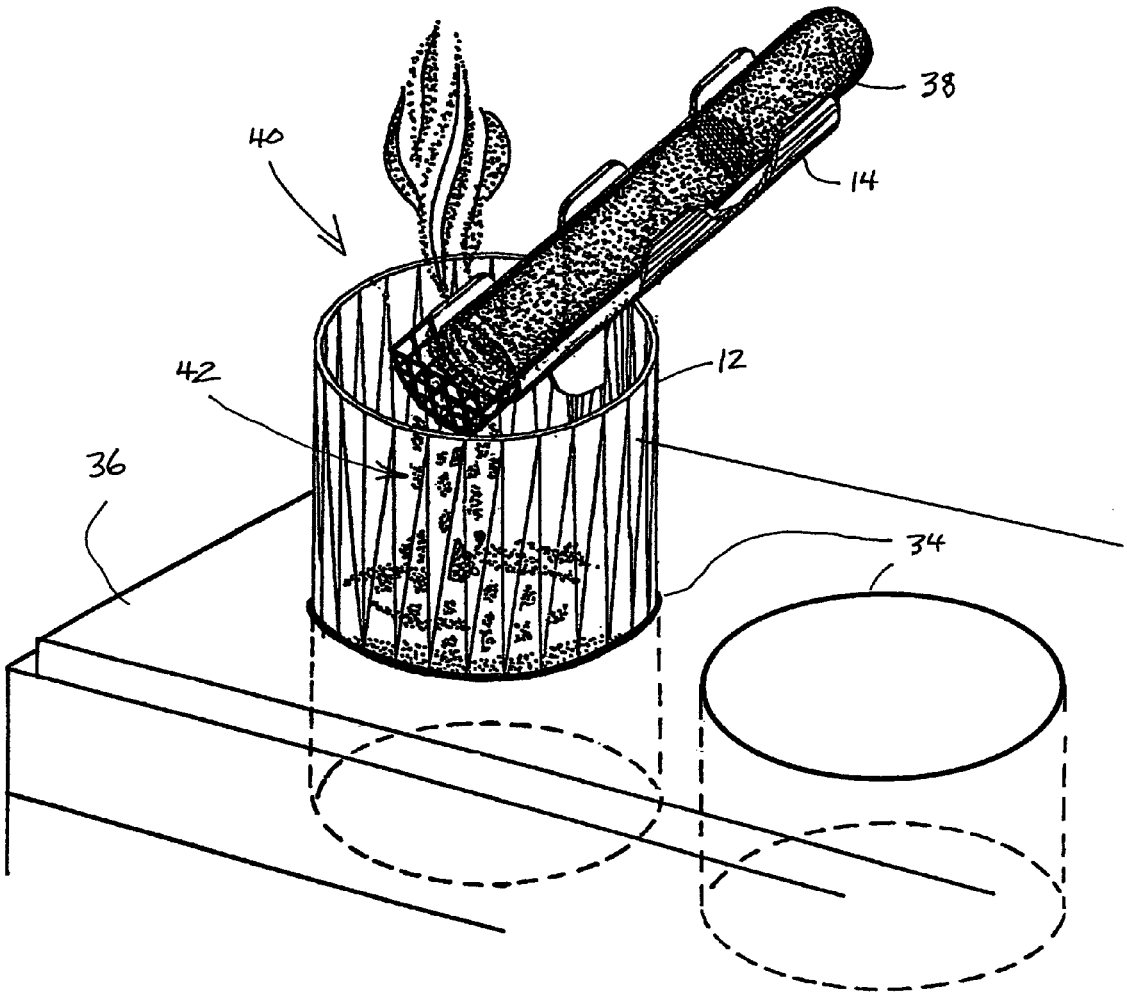
FIG. 3 is a perspective view of one embodiment of the present invention in operative connection with a cup holder.
Figure 4:
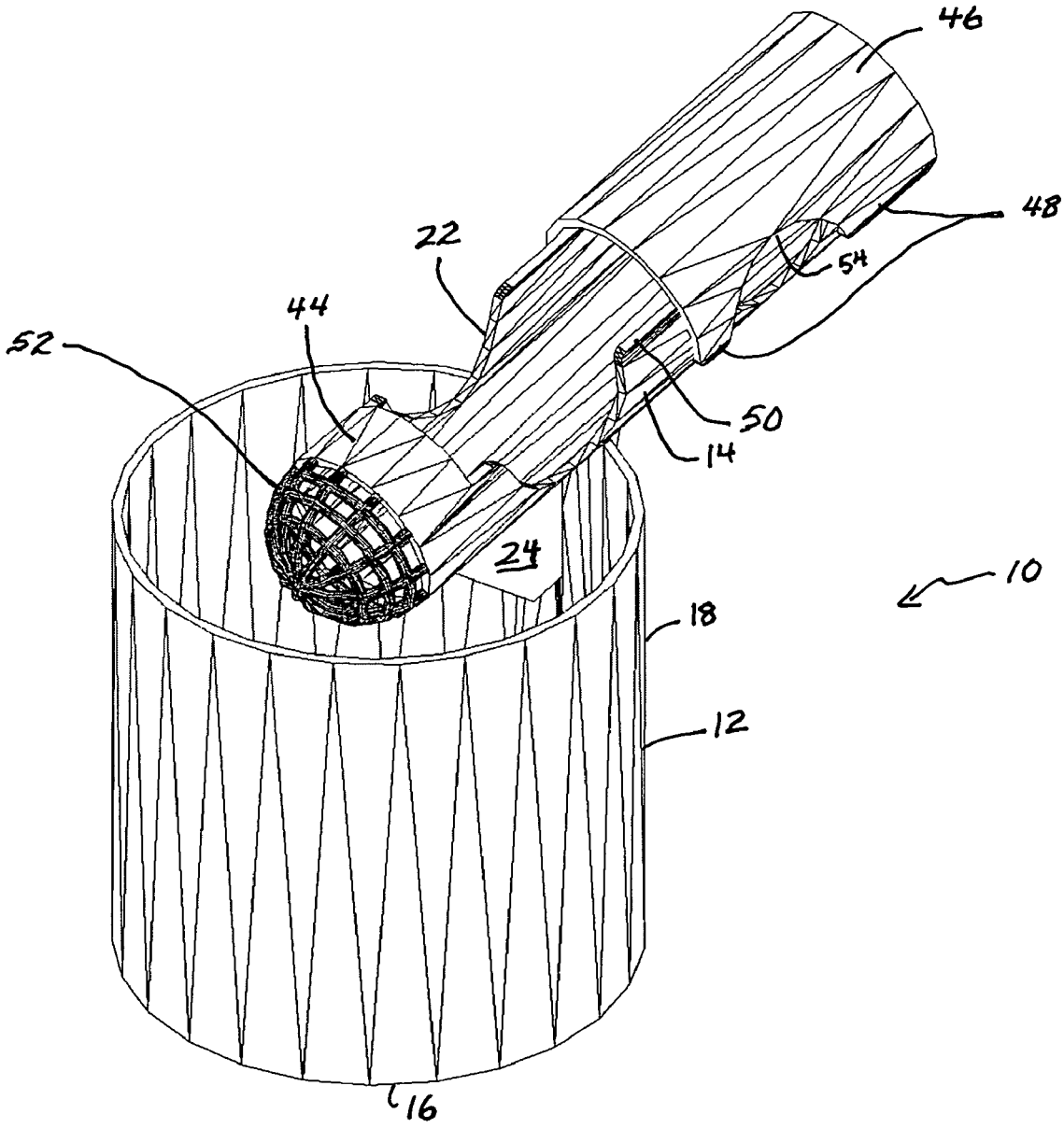
FIG. 4 is a perspective view of one embodiment of the present invention.
Figure 5:
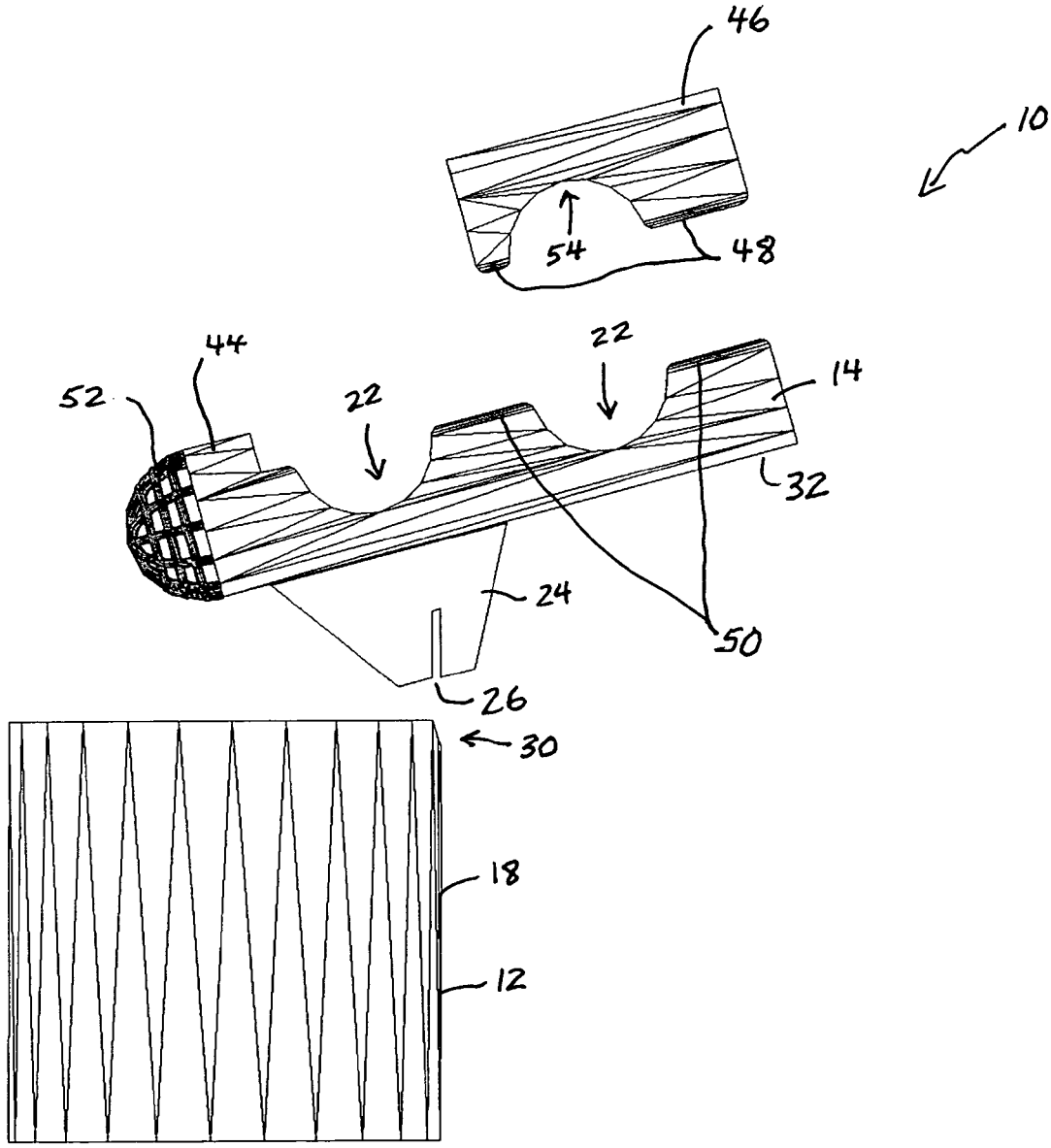
FIG. 5 is an exploded elevation view of one embodiment of the present invention.
Figure 6:
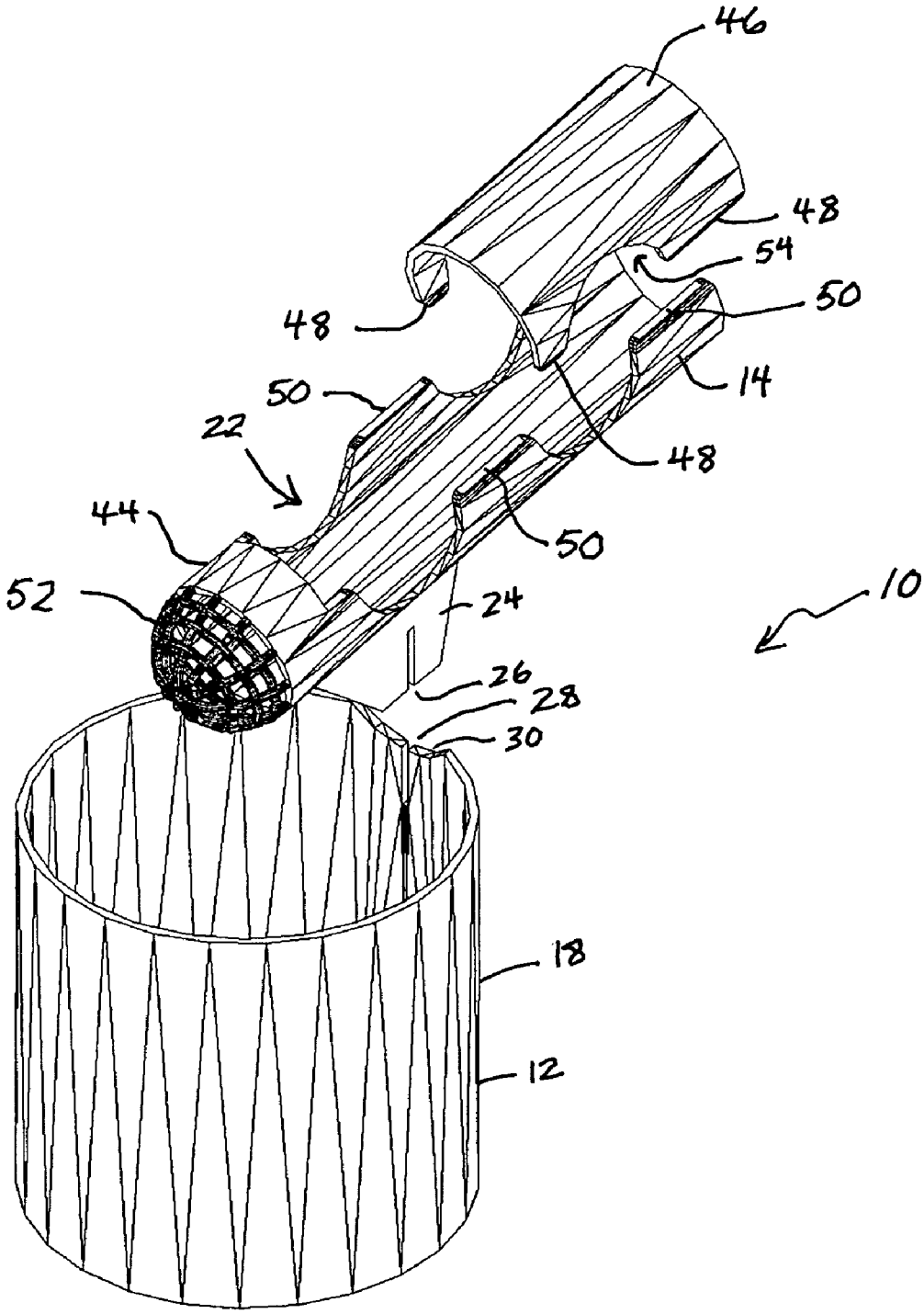
FIG. 6 is an exploded perspective view of one embodiment of the present invention.
Figure 7:
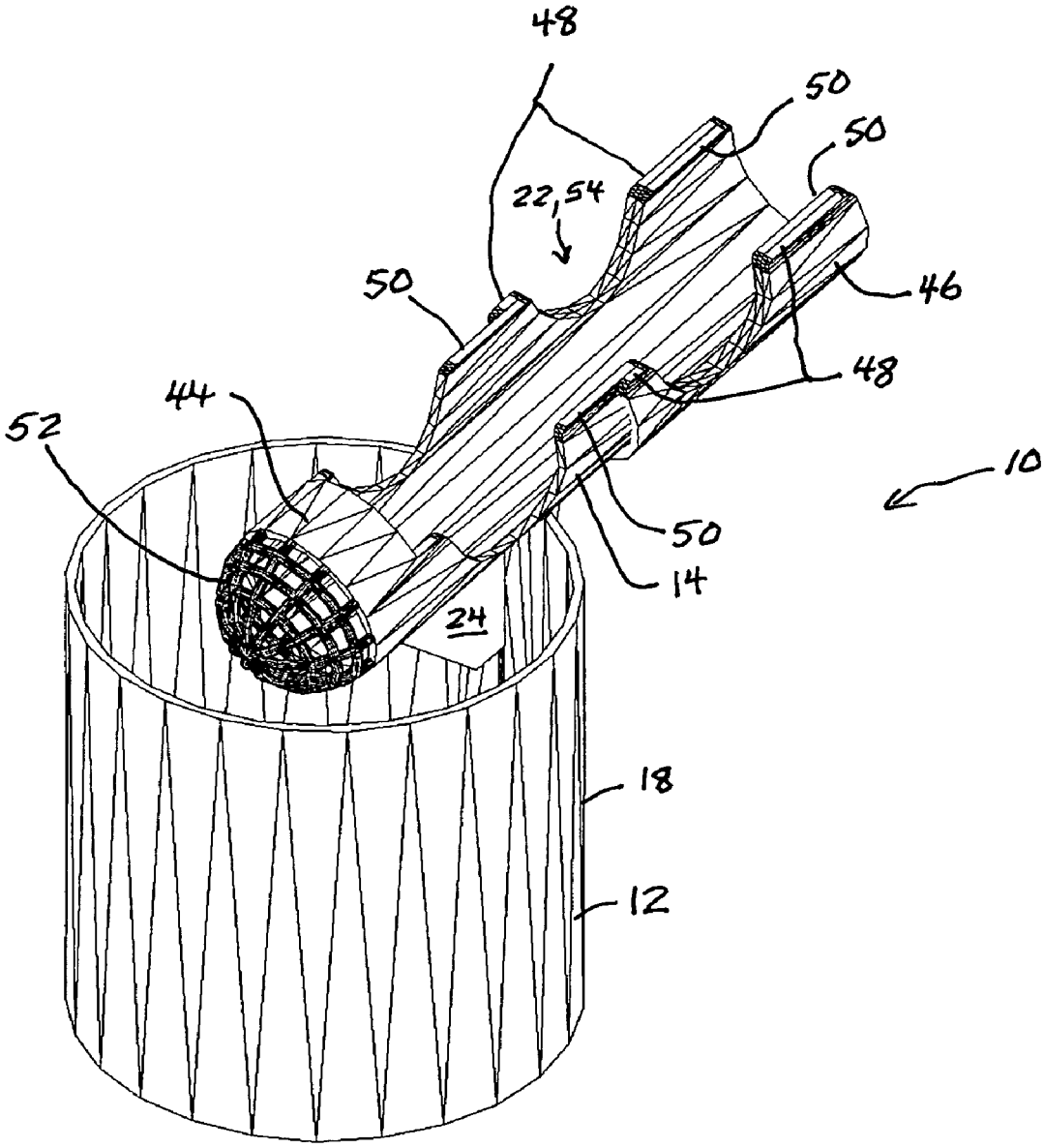
FIG. 7 is a perspective view of one embodiment of the present invention.

With regard to reference numerals used, the following numbering is used throughout the drawings.

10 present invention
12 base
14 holder
16 bottom
18 wall
20 screen
22 finger recess
24 flange
26 slot
28 slot
30 recess
32 underside
34 cup holder
36 automobile
38 cigar
40 lit end/tip
42 ashes
44 circumferential collar
46 partial collar
48 side wall
50 side wall
52 screen
54 recess

DETAILED DESCRIPTION OF THE PREFERRED EMBODIMENT

Turning now descriptively to the drawings, in which similar reference characters denote similar elements throughout the several views which illustrate the present invention wherein a cigar holder and ash tray are disclosed.

Turning to FIGS. 1 through 3, shown therein is the present invention 10 having a cup-like base member 12 and a U-shaped cigar holder member 14. The base 12 has a bottom 16 along with circumferential walls 18 wherein a cylindrical container being open at its top is formed. The purpose of the base 12 is to receive ashes from a cigar in the holder member 14 and also to form a member which can fit into a standard, round drink holder 34 such as might be found in an automobile, golf cart or a golf bag as shown at 36. Also shown is the holder element 14 for receiving a lit cigar 38 therein. The lit end or tip 40 of the cigar 38 is disposed downwardly toward a screen element 20 which entirely covers the end of the cigar so that the ashes 42 from the cigar can be frictionally scraped off from the cigar tip and fall through the multiple apertures of the screen member 20 into the base 12 where the ashes are collected. Screen 20 may be substantially perpendicular to the end of a lit cigar 38. The apertures in screen 20 are also effectively sized to provide sufficient air flow to the burning or lit end 40 of the cigar 38. The holder member 14 also shows a plurality of slotted recesses 22 which are designed to be effectively long to allow the user's fingers to grasp the body of a cigar 38 in a plurality of places so that as the cigar becomes shorter in length during the smoking process, the user will be able to always grasp the cigar at a convenient location. Also shown is a downwardly disposed flange member 24 on the underside 32 of holder 14 which has a slot 26 therein which flange slot 26 mates to a like size second slot 28 disposed in the upper wall 18 of the base 12 so that the holder member 14 can be joined to the base member 18 in a removably fixed fashion. Also shown on the base 12 is a recessed area 30 complementarily shaped as the bottom 32 of the holder member so that the underside of the holder member 14 mates into the recess 30 to also secure the holder member to the base member 12. The base 12 and holder 14 can therefore be made of two pieces and removably attached to each other.

Turning to FIGS. 4-7, shown therein is an alternative embodiment of the present invention 10 having the features as shown in FIGS. 1-3, and, in addition, includes other features including a collar 44 disposed on the end of holder 14 toward the lit end of a cigar, which collar extends 360 degrees around the circumference of the holder and acts to retain a cigar in the holder when the cigar becomes short during the smoking experience. Screen 52 is rounded on its end in this embodiment. Locking collar 46 is adapted for rotatable disposition around the holder 14 and serves to hold a cigar in the holder 14 as the cigar is being smoked by a user. Collar 46 will prevent the cigar from being jolted from holder 14 due the holder being bounced around or jostled about due to, e.g., rough terrain. The tips of the side walls 48 of collar 46 extend an effective distance around the circumference of holder 14 so as to enable the collar to be secured around the holder to prevent the collar from coming loose from the holder, yet allow the fingers of a user to rotate the collar about the holder to allow the user to remove the cigar from the holder when the user desires to puff on the cigar. Collar 46 also has a second recess 54 therein which is complementarily sized for coalignment with recess 22 in holder 14 when the collar 46 is rotated to a position underneath the holder. The tips of the side walls 48 are biased inwardly an effective amount toward the axial centerline of the holder 14 so as to frictionally assist in retaining collar 46 on the holder. The tips of the side walls 48 of collar 46 extend in an arc greater than 180 degrees, but less than 360 degrees, around holder 14 and the tips of the side walls 50 of the holder extend in an effectively sized arc greater than 180 degrees, but less than 360 degrees, so that the tips of side walls 48 and 50 overlap to allow the collar 48 to be rotatably secured about holder 14.

What is claimed to be new and desired to be protected by Letters Patent is set forth in the appended claims.

I claim:

1. An ashtray comprising, in combination:

a) a base, said base being cylindrically shaped having a bottom, circumferential walls, and being open at the top wherein an upper rim is formed around the top of said base, said base being removably mounted in a drink holder in a vehicle;

b) a cigar holder having first and second opposing ends, said cigar holder being substantially U-shaped having an underside and a pair of upwardly extending sides, said sides terminating at an upper end forming an open top to receive a lit cigar so that a lit end of the cigar is adjacent said first end;

c) said cigar holder having a downwardly extending flange mounted on the underside of said holder, said flange being aligned with a central axis of said cigar holder and having a distal edge, said distal edge having a slot to mate with a slot formed in the upper rim of said base for removably mounting said cigar holder on said base so that said first end of said cigar holder is disposed over said open end of said base; and, d) a screen being disposed on said first end of said cigar holder so that ashes from a lit cigar can be scraped off and fall through the screen into said base, said screen being U-shaped to match a contour of said first end of said cigar holder.

2. The ashtray of claim 1, wherein said upper ends of said sides of said cigar holder have a plurality of recesses therein, wherein said recesses are spaced apart along said upper ends of said sides, wherein the fingers of a user can grasp the cigar at a plurality of locations.

3. The ashtray of claim 2, in which an upper edge of a circumferential wall of said base has a recess in which said slot mating with said slot in said flange is located.

4. The ashtray of claim 3, wherein said first end of said cigar holder is lower than the said second end to permit a cigar to be retained in the cigar holder.

5. An ashtray, comprising, in combination:

a) a base, said base being cylindrically shaped having a bottom, circumferential walls, and being open at the top wherein an upper rim is formed around the top of said base, and sized to fit into a drink holder in a vehicle;

b) a cigar holder having first and second opposing ends, said cigar holder being substantially U-shaped having an underside and a pair of upwardly extending sides, said sides terminating at an upper end forming an upper top to receive so that a lit end of the cigar is adjacent said first end, said upper ends of said sides of said cigar holder having a plurality of spaced recesses therein, wherein said recesses are spaced apart along said upper ends of said sides, wherein the fingers of a user can grasp the cigar at a plurality of locations;

c) wherein said cigar holder is adapted for mounting onto said base so that said first end of said cigar holder is disposed over said open end of said base;

d) a screen being disposed on said first end of said cigar holder so that ashes from a lit cigar can be scraped off and fall through the screen into said base, said screen having a plurality of apertures therein, wherein said apertures are sized to provide air flow to a lit cigar disposed in said cigar holder; and e) a circumferential collar rotatable on said holder surrounding and covering the upper opening of said holder for securing a cigar in said holder, said collar having sidewalls covering a sufficient portion of a circumference of said holder to prevent said collar from coming loose from the holder, said side walls having edges with recesses for alignment with recesses in said holder when said collar is moved to allow access to said cigar.

6. The ashtray of claim 5, wherein said screen is mounted on and fully encloses said first end of said holder and abuts a leading edge of said collar when fully deployed on said holder.

7. The ashtray of claim 6, wherein said first end of said cigar holder is lower than the said second and to permit a cigar to be retained in the cigar holder.

8. The ashtray of claim 7, further comprising a downwardly disposed flange disposed on said underside of said cigar holder intermediate said first and second end of said cigar holder, said flange having a first slot therein, wherein said upper rim of said base has a second slot therein, wherein said first slot mates with said second slot so that said cigar holder becomes securely connected to said base, wherein said cigar holder can be removed from said base by a user wherein said base and said cigar holder are made of two pieces.

* * * * *